US008322840B2

(12) United States Patent
Okamori

(10) Patent No.: US 8,322,840 B2
(45) Date of Patent: Dec. 4, 2012

(54) PATTERN FORMATION METHOD

(75) Inventor: Kazuaki Okamori, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 340 days.

(21) Appl. No.: 12/659,770

(22) Filed: Mar. 22, 2010

(65) Prior Publication Data

US 2010/0238244 A1 Sep. 23, 2010

(30) Foreign Application Priority Data

Mar. 23, 2009 (JP) ..... 2009-070141

(51) Int. Cl.
*B41J 2/01* (2006.01)

(52) U.S. Cl. ..... 347/102; 156/277; 347/15; 347/21; 347/43; 347/68; 349/106; 349/155

(58) Field of Classification Search ..... None
See application file for complete search history.

(56) References Cited

U.S. PATENT DOCUMENTS 6,323,921 B1 * 11/2001 Kurauchi et al. ..... 349/106
6,501,527 B1 * 12/2002 Hirose et al. ..... 349/155
6,698,866 B2 * 3/2004 Ward et al. ..... 347/43
7,727,353 B2 * 6/2010 Nair et al. ..... 156/307.3
2005/0001866 A1 * 1/2005 Eguchi et al. ..... 347/15
2005/0190248 A1 * 9/2005 Konno et al. ..... 347/102
2009/0079784 A1 * 3/2009 Chiwata et al. ..... 347/21
2009/0225143 A1 * 9/2009 Fukui ..... 347/102

FOREIGN PATENT DOCUMENTS

JP 2001-083528 3/2001
JP 2005-066530 3/2005
JP 2005-205670 8/2005

* cited by examiner

*Primary Examiner* — Matthew Luu
*Assistant Examiner* — John P Zimmermann
(74) *Attorney, Agent, or Firm* — Jean C. Edwards, Esq.; Edwards Neils PLLC

(57) ABSTRACT

A pattern is formed by carrying out the steps of dropping curable ink linearly onto a substrate, curing the ink dropped onto the substrate, and depositing layers of ink by repeating a process of linearly dropping a predetermined amount of ink onto the cured ink and a process of curing the predetermined amount of ink. In the step of depositing layers of ink, the ink is dropped at dot pitch p that satisfies $p_{min} \leqq p$ when the ink is dropped at dot pitch p, and a minimum dot pitch for preventing the dropped ink from spreading beyond cured landing-position ink that is located at a landing position of the dropped ink is $p_{min}$.

8 Claims, 6 Drawing Sheets

PATTERN FORMATION METHOD

CROSS-REFERENCE TO RELATED APPLICATIONS

The present application claims priority from Japanese Patent Application No. 2009-070141, filed Mar. 23, 2009, the contents of which are herein incorporated by reference in their entirety.

BACKGROUND OF THE INVENTION

1. Field of the Invention

The present invention relates to a pattern formation method for forming a linear pattern by depositing droplets of curable ink by using an inkjet method.

2. Description of the Related Art

As a method for forming a pattern on a substrate, a method for forming a pattern having the thickness of layers deposited on the substrate has been proposed. In the method, curable ink (hereinafter, simply referred to as "ink") is dropped (for example, ejected) onto the substrate by using an inkjet method in such a manner to form a predetermined pattern, and the ink landed on the substrate is cured to form a layer of cured ink. Further, ink is dropped onto the formed layer of ink, and the ink landed on the layer of ink is cured to form another layer. This operation is repeated to deposit layers of ink.

For example, a method for depositing UV (ultraviolet ray) curable ink on a smooth-surface member is proposed (please refer to Japanese Unexamined Patent Publication No. 2005-205670). In the method, the UV curable ink is ejected from an inkjet head to the smooth-surface member, which is a base plane, and an ultraviolet beam is output from a laser head to the ejected UV curable ink to cure the UV curable ink. Further, each of the inkjet head, the laser head and the smooth-surface member is moved to deposit layers of UV curable ink on the smooth-surface member. Further, a feature that the thickness of a layer is adjusted by controlling a distance between the inkjet head and the laser head is described. By controlling the distance, a time period from ejection of the UV curable ink to the start of radiation of a laser beam is adjusted, and the degree of spreading of the ink is adjusted. Consequently, the thickness of the layer is adjusted.

Further, a method that can prevent clogging of the outlets of nozzles and form a linear pattern with a high aspect ratio without losing the close-contact characteristic has been proposed (please refer to Japanese Unexamined Patent Publication No. 2005-066530). In the method, tiny droplets of liquid are output from the outlets of nozzles at predetermined cycle, and the ejected tiny droplets of liquid are irradiated with pulse light beams. The pulse light beams are output in a time period from time immediately after the tiny droplets of liquid are ejected to time immediately after the tiny droplets of liquid reach the substrate. However, within the period, the pulse light beams are not output in a time period from time immediately before other tiny droplets of liquid are ejected from the outlets of the nozzles to time immediately after the other tiny droplets of liquid are ejected.

Further, a method for forming a spacer that regulates a distance between a pair of substrates is proposed (please refer to Japanese Unexamined Patent Publication No. 2001-083528). The spacer is formed by applying, a plurality of times, a spacer formation material to the same position on the substrate and by curing the applied spacer formation material. Further, a feature that the spacer that has a required height can be more easily formed by reducing the amount of the spacer formation material applied in the second or later application process than that of the spacer formation material applied in the first application process is described.

Here, in the method of forming a three-dimensional pattern by depositing layers of ink by using an inkjet method, when ink lands onto cured ink, the landed ink may spread depending on the properties of the ink (for example, wettability). The landed ink may spread beyond the cured ink under the landed ink (leak from the area of the cured ink under the landed ink to the outside of the area).

To solve this problem, Japanese Unexamined Patent publication No. 2005-205670 adjusts the degree of spreading of wet ink by controlling the time period from landing of the ink to output of a laser beam. When the ink is cured within a predetermined time period after landing, it is possible to prevent the wet ink from spreading. Further, when the ink is cured immediately after landing, it is possible to form a thick layer, in other words, it is possible to cure the landed ink in a high aspect ratio state.

Further, in the method disclosed in Japanese Unexamined Patent Publication No. 2005-066530, flying ink that has been ejected from the nozzles is irradiated with a pulse light beam to make the ink start curing while dropping. In the method, the ink lands onto the substrate after the viscosity of the ink is increased. Therefore, it is possible to cure the ink in a high aspect ratio state.

However, in the method disclosed in Japanese Unexamined Patent Publication No. 2005-205670, the landed ink must be irradiated with a laser beam within a predetermined short period after landing to prevent the wet ink from spreading. Further, in the method disclosed in Japanese Unexamined Patent Publication No. 2005-066530, the ink must be irradiated with light in a time period from time of ejection to time immediately after landing. Therefore, it is necessary that the inkjet head and a light radiation means are arranged in close proximity to each other. Consequently, there is a problem that the flexibility of the apparatus and method becomes lower. In the method disclosed in Japanese Unexamined Patent Publication No. 2005-066530, light for curing the ink is output from a position in the proximity of the inkjet head. Therefore, even if the radiation timing is adjusted, clogging of the nozzles tends to occur by repeated exposure. Consequently, the productivity of the pattern becomes lower.

Further, in the method disclosed in Japanese Unexamined Patent Publication No. 2001-083528, it is possible to prevent the wet ink from spreading by gradually reducing the amount of ink ejected. However, the thickness of a pattern formed by using the method is limited. Further, since the amount of ink is gradually reduced, when a thick pattern is formed, the ink must be ejected many times. Therefore, there is a problem that the productivity of the pattern becomes lower.

SUMMARY OF THE INVENTION

In view of the foregoing circumstances, it is an object of the present invention to make it possible to form a thick linear pattern at high productivity.

A pattern formation method of the present invention is a pattern formation method comprising the steps of:

dropping curable ink linearly onto a substrate;

curing the ink dropped onto the substrate; and depositing layers of ink to form a linear pattern by repeating a process of linearly dropping a predetermined amount of ink onto the cured ink and a process of curing the predetermined amount of ink, wherein in the step of depositing layers of ink, the ink is dropped at dot pitch p that satisfies $p_{min} \leqq p$ when the ink is dropped at dot pitch p, and a minimum dot pitch for preventing the dropped ink from spreading beyond cured landing-position ink that is located at a landing position of the dropped ink is $p_{min}$.

A linear pattern formed by the present invention may include a straight pattern and a curved pattern (non-straight pattern). Further, a pattern represented by the term "linear pattern" may include a pattern having a width greater than or equal to two dots of dropped ink.

In the pattern formation method of the present invention, in the step of depositing layers of ink, the ink may be dropped at dot pitch p that further satisfies $p \leqq p_{max}$ when a maximum dot pitch that can avoid jaggy generation is $p_{max}$.

In the pattern formation method of the present invention, in the step of depositing layers of ink, the ink may be dropped at dot pitch p that satisfies $p_{min} \leqq p+a$ when the accuracy of landing by the dropped ink is a.

In the pattern formation method of the present invention, in the step of depositing layers of ink, the minimum dot pitch $p_{min}$ may be determined based on the predetermined amount of ink and the area of a cross section of a pattern formed by the dropped ink.

In the pattern formation method of the present invention, in the step of depositing layers of ink, the area of the cross section may be calculated based on a contact angle between the dropped ink and the landing-position ink.

In the pattern formation method of the present invention, the ink may be curable by irradiation with an electromagnetic wave including a visible ray or an invisible ray. Further, in the step of curing the ink, the ink may be cured by irradiating the ink with the electromagnetic wave. Further, in the step of depositing layers of ink, the contact angle may be controlled based on the properties of the ink and the time period and the intensity of irradiating the landing-position ink.

The pattern formation method of the present invention may further include the step of carrying out liquid-repellent treatment on a surface of the ink that has been cured in the step of curing. Further, in the step of depositing layers of ink, after the dropped ink is cured, liquid-repellent treatment may be carried out on the surface of the cured dropped ink, and the contact angle may be controlled based on the properties of the ink on which the liquid-repellent treatment has been carried out.

In the pattern formation method of the present invention, in the step of depositing layers of ink, when a contact angle between the dropped ink and the landing-position ink is $\theta_n$, a contact angle between the landing-position ink and an object on which the landing-position ink has landed is $\theta_{n-1}$, an angle between a tangent line to the surface of the landing-position ink and a plane parallel to the surface of the substrate at a point of contact between the surface of the dropped ink and the landing-position ink is $\phi_{n-1}$, an angle between a tangent line to the surface of the object and a plane parallel to the surface of the substrate at a point of contact between the landing-position ink and the object on which the landing-position ink has landed is $\phi_{n-2}$, and the area of the cross section is $S_n$, the area $S_n$ of the cross section may be calculated by the following formula:

$$S_n = \left[(\phi_{n-1} + \theta_n)\frac{d_n}{2\sin(\phi_{n-1} + \theta_n)} - \left\{(\phi_{n-2} + \theta_{n-1})\frac{d_{n-1}}{2\sin(\phi_{n-2} + \theta_{n-1})} - \frac{d_n}{4}\left(\frac{d_{n-1}}{\tan(\phi_{n-2} + \theta_{n-1})} - \frac{d_n}{\tan(\phi_{n-1} + \theta_n)}\right)\right\}\right].$$

In the pattern formation method of the present invention, in the step of depositing layers of ink, the ink may be dropped from a piezoelectric-type inkjet head, and the predetermined amount of ink may be adjusted by the waveform of drive voltage applied to a piezoelectric element of the piezoelectric-type inkjet head.

In the pattern formation method of the present invention, in the step of depositing layers of ink, the predetermined amount of ink may be adjusted by changing the number of times dropping the ink.

According to the present invention, when ink is dropped at dot pitch p, and a minimum dot pitch for preventing the dropped ink from spreading beyond cured landing-position ink that is located at a landing position of the dropped ink is $p_{min}$, the ink is dropped at dot pitch p that satisfies $p_{min} \leqq p$. Therefore, it is possible to drop the ink without making the wet dropped ink spread beyond the cured ink, in other words, without making the dropped ink spread or leak beyond the border of the cured ink. Consequently, it is possible to form a high-resolution pattern with a high aspect ratio without losing the flexibility and productivity of the apparatus and method.

When a maximum dot pitch that can avoid jaggy generation is $p_{max}$, if the ink is dropped at dot pitch p that further satisfies $p \leqq p_{max}$, it is possible to form a pattern without jaggy.

DESCRIPTION OF THE PREFERRED EMBODIMENTS

Figure 1:
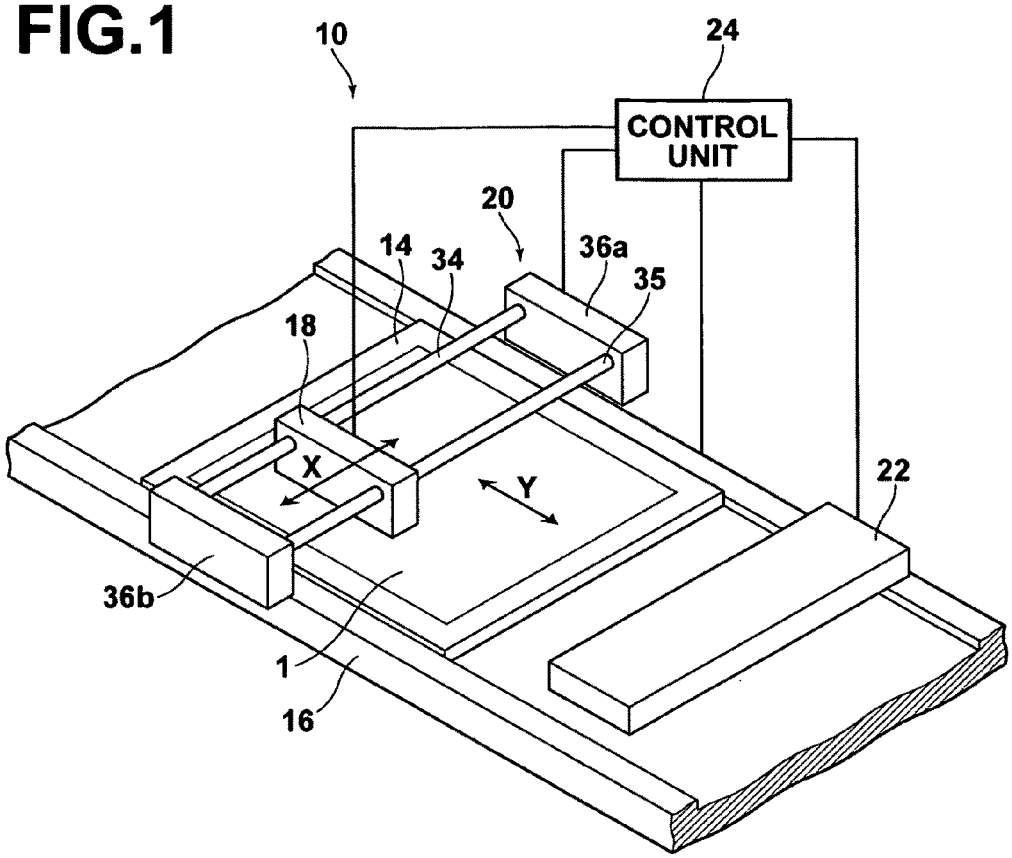
FIG. 1 is a schematic diagram illustrating a perspective view of the structure of a pattern formation apparatus for carrying out a pattern formation method according to an embodiment of the present invention.

Hereinafter, embodiments of the present invention will be described with reference to drawings. FIG. 1 is a schematic diagram illustrating a perspective view of a pattern formation apparatus for carrying out a pattern formation method according to an embodiment of the present invention. As illustrated in FIG. 1, a pattern formation apparatus 10 includes a support member 14, a support member movement mechanism 16, an inkjet head 18, a head movement mechanism 20, an exposure mechanism 22, and a control unit 24. A substrate 1 in flat-plate form is placed on the support member 14. The support member movement mechanism 16 moves the support member 14 in one direction, and the inkjet head 18 ejects curable ink (hereinafter, simply referred to as "ink") onto the substrate 1. The head movement mechanism 20 moves the inkjet head 18 in a direction perpendicular to the direction of movement of the support member 14. The exposure mechanism 22 exposes ink landed on the substrate 1 to light, and the control unit 24 controls the operation by each element.

The substrate 1 is a non-permeable plate-form member or film into which ink does not permeate (penetrate). As the substrate 1, a plate-form member made of various kinds of material, such as a glass substrate, a metal substrate and a plastic substrate, may be used. Further, various kinds of film may be used as the substrate 1. For example, polyethylene terephthalate film, polybutylene terephthalate film, polycycloolefin film, biaxial stretch polypropylene film, polycarbonate film, polyamide film, polyvinyl chloride film, methacrylate-styrene resin film, polyimide film, silicon resin film, fluorine resin film or the like may be used.

The ink is photocurable ink, which is cured by irradiation with light. For example, photocurable monomer ink of radical polymerization type or cationic polymerization type may be used.

The support member 14 is a plate-form member that can fix the substrate 1 on a surface thereof. The method for fixing the substrate 1 by the support member 14 is not particularly limited. The support member 14 may mechanically fix the substrate 1 by holding the substrate 1 from two facing ends of the substrate 1. Alternatively, the support member 14 may fix the substrate 1 by electrostatic adsorption. Alternatively, a suction hole may be provided on the surface of the support member 14, and the substrate 1 may be fixed by sucking air through the suction hole.

The support member movement mechanism 16 moves the support member 14 in one direction (direction Y in FIG. 1) parallel to the surface of the support member 14 in such a manner that the surface of the support member 14 is maintained on the same plane. Various kinds of conveyance mechanism may be used as the support member movement mechanism 16. For example, a belt conveyance mechanism, a linear conveyance mechanism, a roller conveyance mechanism or the like may be used. The roller conveyance mechanism conveys the support member by rollers that hold the facing ends of the support member 14.

The inkjet head 18 is a means for dropping ink onto the substrate 1. The inkjet head 18 is arranged so as to face the surface of the support member 14 on which the substrate 1 is supported by the support member 14. Here, various kinds of inkjet head may be used. For example, a piezoelectric-type inkjet head, a thermal-type inkjet head, an electrostatic actuator type inkjet head, an electrostatic suction type inkjet head, or the like may be used. It is desirable to use the piezoelectric-type inkjet head because the amount (or volume) of ink dropped from the inkjet head can be easily adjusted. Further, the inkjet head 18 may be a multi-channel head having a plurality of nozzles for dropping the ink. Accordingly, it is possible to simultaneously drop ink onto a plurality of positions.

The head movement mechanism 20 includes a drive screw 34, a guide rail 35, a drive support unit 36*a*, and a support unit 36*b*. The head movement mechanism 20 moves the inkjet head 18 in a direction (direction X in FIG. 1) that is perpendicular to the direction (direction Y) of the movement of the support member 14. The head movement mechanism 20 moves the inkjet head 18 parallel to the surface of the support member 14.

Each of the drive screw 34 and the guide rail 35 is arranged in the conveyance direction (direction X in FIG. 1) of the inkjet head 18 across the substrate 1 in such a manner to straddle the sides of a largest usable substrate 1. The drive screw 34 includes a ball screw (not illustrated) and the like, and the ball screw includes a male thread portion that is engaged with a female thread portion (not illustrated) formed on the inkjet head 18. The drive screw 34 moves the inkjet head 18 in direction X by rotation. The guide rail 35 is inserted into a through-hole formed in the inkjet head 18, and guides the inkjet head 18 in such a manner that the posture of the inkjet head 18 moving by rotation of the drive screw 34 is maintained.

Further, the drive support unit 36*a* is provided on an end of the drive screw 34 and an end of the guide rail 35. The support unit 36*b* is provided on the other end of the drive screw 34 and the other end of the guide rail 35. The drive support unit 36*a* and the support unit 36*b* support the drive screw 34 in such a manner that forward/reverse rotation of the drive screw 34 is possible. The drive support unit 36*a* and the support unit 36*b* support the guide rail 35 in such a manner that the guide rail 35 does not move. The drive support unit 36*a* includes a drive source (not illustrated), such as a motor, for driving the drive screw 34. The drive support unit 36*a* and the support unit 36*b* are supported by a case (not illustrated) of the apparatus.

The head movement mechanism 20 can move, forward and backward, the inkjet head 18 in direction X (main scan direction) by making the drive screw 34 rotate forward and reverse by the drive support unit 36*a* while the inkjet head 18 is guided by the guide rail 35.

The head movement mechanism 20 may include a plurality of guide rails to maintain the posture of the inkjet head 18 in such a manner that an ink-dropping surface of the inkjet head 18 keeps facing the support member 14. Alternatively, the head movement mechanism 20 may include a different kind of posture maintaining mechanism.

Here, the movement mechanism of the inkjet head 18 is not limited to the aforementioned head movement mechanism 20. Various kinds of known movement mechanism may be used. For example, the drive screw may be a rod-form member, such as a guide rail, and a guide wire may be attached to each end of the inkjet head 18 in direction X. The inkjet head 18 may be moved along the guide rail by winding the guide wire on the movement direction side. Alternatively, the inkjet head 18 may be moved by a timing belt instead of the guide wire. In such a case, sprockets for the timing belt may be used instead of wire reels for winding the guide wires. The movement mechanism may be a rack-and-pinion mechanism, a self-propelled-type mechanism, a linear motor, or the like.

The exposure mechanism 22 exposes the ink that has been dropped onto the substrate 1 from the inkjet head 18 to light by irradiating the substrate 1 with light. The exposure mechanism 22 is a light irradiation mechanism that can adjust the intensity of irradiation. The exposure mechanism 22 is arranged so as to face a substrate-1-supporting surface of the support member 14. The exposure mechanism 22 is arranged across the support member 14 to cover both ends of the support member 14 in direction X in FIG. 1.

The exposure mechanism 22 should be a light irradiation mechanism for outputting light that can cure the ink, and various kinds of light irradiation mechanism may be used. For example, the exposure mechanism 22 may be a metal halide lamp, a high-pressure mercury lamp, an LED (light-emitting diode), a solid-state laser, a gas laser, a semiconductor laser, or the like. Further, the wavelength of the light output from the exposure mechanism 22 may be various wavelengths based on the type of the ink. Various kinds of light, such as ultraviolet rays, visible light, infrared rays, and X-rays, may be used. Further, an irradiation mechanism that outputs electromagnetic waves including various kinds of light and microwaves may be used as the exposure mechanism depending on the kind of ink. Further, the intensity of light (or electromagnetic waves) output from the exposure mechanism 22 may be adjusted to various intensities by changing the strength of voltage supplied to the exposure mechanism, changing the kind of a filter, or the like.

The control unit 24 controls the action of the support member movement mechanism 16, the inkjet head 18, the head movement mechanism 20 and the exposure mechanism 22. Specifically, the control unit 24 controls the conveyance speed, distance and timing of the substrate 1, the amount of ink to be dropped and the timing of dropping the ink, the movement speed, distance and timing of the inkjet head 18, the intensity of light output from the exposure mechanism 22, the timing of irradiation by the exposure mechanism 22, and the like. The method for connecting the control unit 24 to each element is not particularly limited as long as signals can be transmitted between the control unit 24 and each of the elements. They may be connected to each other by a wire or through a wireless network.

The control unit 24 calculates, based on received data on a pattern to be formed, amount V of ink to be dropped for each layer, dot pitch p, and the cure conditions of the dropped ink, before an actual pattern formation operation is started. The control unit 24 stores the calculated information in a memory (not illustrated) in the control unit 24.

First, with respect to the first layer, the control unit 24 calculates, based on contact angle $\theta_1$ between the dropped ink (the ink to be dropped) and the substrate 1, amount V of ink to be dropped to form a pattern having a line width as designed. Further, the control unit 24 calculates dot pitch p so that the dot pitch p is less than or equal to maximum dot pitch $p_{max}$ that can avoid jaggy generation. In the present embodiment, it is assumed that the amount V of ink to be dropped is the same for every layer.

With respect to an n-th layer ($n \geqq 2$), the control unit 24 calculates, based on the cure conditions of the cured ink on the substrate 1 and the properties of the ink, contact angle $\theta_n$ between the dropped ink and the cured ink on the substrate. To be more precise, the cured ink on the substrate 1 is the cured ink located at the landing position of the dropped ink (hereinafter referred to as "landing-position ink"). The cure conditions of the ink are the conveyance speed, the intensity of light, or the like during exposure.

Further, the area $S_n$ of the cross section of a pattern formed by landing of the dropped ink on the landing-position ink is calculated based on the calculated contact angle $\theta_n$ and the form of the pattern formed by the landing-position ink. Further, the dot pitch p of the ink is calculated based on the area $S_n$ of the cross section. The dot pitch p is calculated so that the dot pitch is greater than or equal to minimum dot pitch $p_{min}$ for preventing the dropped ink from spreading beyond cured landing-position ink and less than or equal to maximum dot pitch $p_{max}$ that can avoid jaggy generation.

Further, the cure conditions of the dropped ink are calculated so that the contact angle between the dropped ink and ink that is further dropped onto the dropped ink becomes an optimum contact angle (for example, so that the sum of an angle between the substrate 1 and the surface of the dropped ink and the contact angle is 90 degrees).

The method for calculating the contact angle $\theta_n$, the area $S_n$ of the cross section, the dot pitch p, and the ink cure conditions will be described later.

Figure 2:
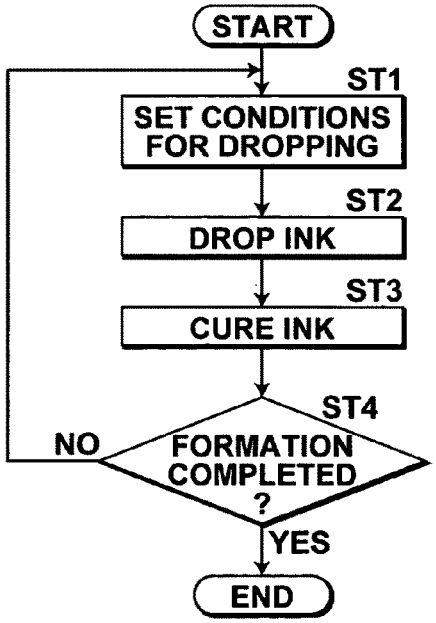
FIG. 2 is a flow chart showing the operation of the pattern formation apparatus according to an embodiment of the present invention.

Next, the operation of the pattern formation apparatus 10 according to the present embodiment will be described. FIG. 2 is a flow chart illustrating the operation of the pattern formation apparatus according to the present embodiment. It is assumed that the substrate 1 is fixed at a predetermined position of the support member 14, and the support member 14 to which the substrate 1 is fixed has been conveyed in direction Y, and the substrate has been moved to an initial position facing the inkjet head 18.

First, the control unit 24 reads out the timing of ejecting ink for the first layer, the amount V of ink to be dropped, the dot pitch p, and the cure conditions of the dropped ink from a memory, and sets the ink dropping conditions (step ST1). Next, the ink is dropped onto the substrate 1 based on the set ink dropping conditions (step ST2).

Specifically, first, while the inkjet head 18 is moved in direction X by the head movement mechanism 20, ink is dropped from the inkjet head 18 onto the substrate 1 facing the inkjet head 18. The inkjet head 18 drops ink only to a necessary position or positions on the substrate based on a pattern to be formed by using the amount V of ink and the dot pitch p that have been read out by the control unit 24.

Figure 3:
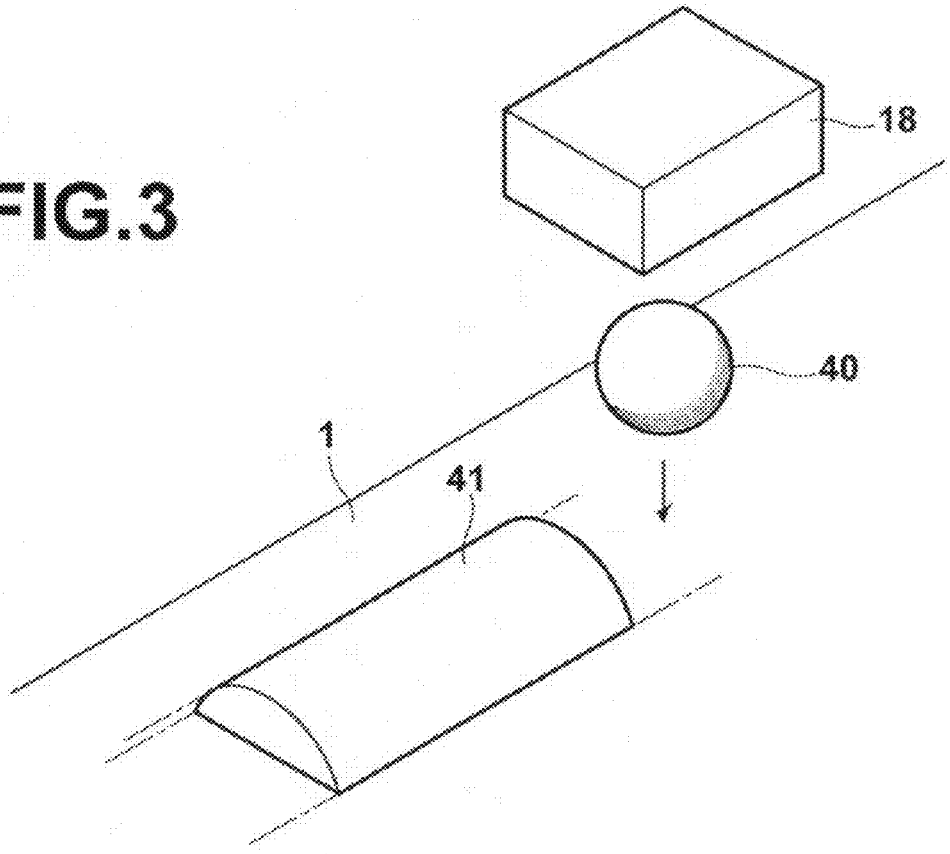
FIG. 3 is a diagram for explaining formation of a pattern in a first layer.

FIG. 3 is a diagram for explaining formation of a pattern in the first layer. As illustrated in FIG. 3, a droplet 40 of ink ejected from the inkjet head 18 lands onto the substrate 1, and a pattern 41 in the first layer is formed. In FIG. 3, the dot dashed lines indicate the form of the pattern. As illustrated in FIG. 3, the formed pattern has semi-cylindrical form (so-called kamaboko form in Japanese).

The head movement mechanism 20 moves the inkjet head 18 from a side of the substrate 1 to the other side of the substrate 1 to drop ink onto the substrate 1. After the ink is dropped onto the entire area of the substrate 1 facing the movement area of the inkjet head 18, the control unit 24 controls the support member movement mechanism 16 to move the substrate 1 in direction Y by a predetermined distance.

After then, the head movement mechanism 20 moves the inkjet head 18 from a side of the substrate 1 to the other side of the substrate again. After the ink is dropped onto the entire area of the substrate 1 facing the movement area of the inkjet head 18, the support member movement mechanism 16 moves the substrate 1 in direction Y by a predetermined distance.

As described above, the operation of dropping ink from the inkjet head 18 and the operation of moving the substrate 1 by a predetermined distance by the support member movement mechanism 16 are repeated to drop ink onto the entire area of the substrate 1 so as to form a predetermined pattern.

After the ink is dropped onto the entire area of the substrate 1, the ink dropped onto the substrate 1 is cured (step ST3). Specifically, the support member movement mechanism 16 moves the substrate 1 to a position facing the exposure mechanism 22. Then, while the support member movement mechanism 16 conveys the substrate 1 at a predetermined speed, the exposure mechanism 22 irradiates the substrate 1 with light to cure the ink dropped onto the substrate 1. The conveyance speed of the substrate 1 by the support member movement mechanism 16 and the intensity of light output from the exposure mechanism 22 are set by the control unit 24. When the ink dropped onto the substrate 1 is cured, a judgment is made as to whether formation of a pattern has been completed (step ST4).

If it is judged that formation of the pattern is not completed, in other words, if it is judged that it is necessary to drop more ink to form a layer, the process goes back to step ST1. When it is judged that formation of the pattern is completed, processing ends.

The above descriptions explain formation of the first layer. After formation of the first layer, processing goes back to step ST1 to form the second layer. First, the control unit 24 reads, from a memory, the amount of ink to be dropped, the dot pitch p, and the cure conditions of the dropped ink for the second layer, and sets the ink dropping conditions (when the process is the n-th (n>2) repetition of step ST1, data for the n-th layer are read out from the memory, and the ink dropping conditions for the n-th layer are set) (step ST1).

Next, the control unit 24 returns the substrate 1 to the initial position, and the inkjet head 18 drops ink onto the cured ink on the substrate 1 (step ST2). Specifically, while the head movement mechanism 20 moves the inkjet head 18, the inkjet head 18 drops ink onto the cured ink on the substrate 1 at the amount V of ink to be dropped and the dot pitch p that have been read out from the memory.

Figure 4:
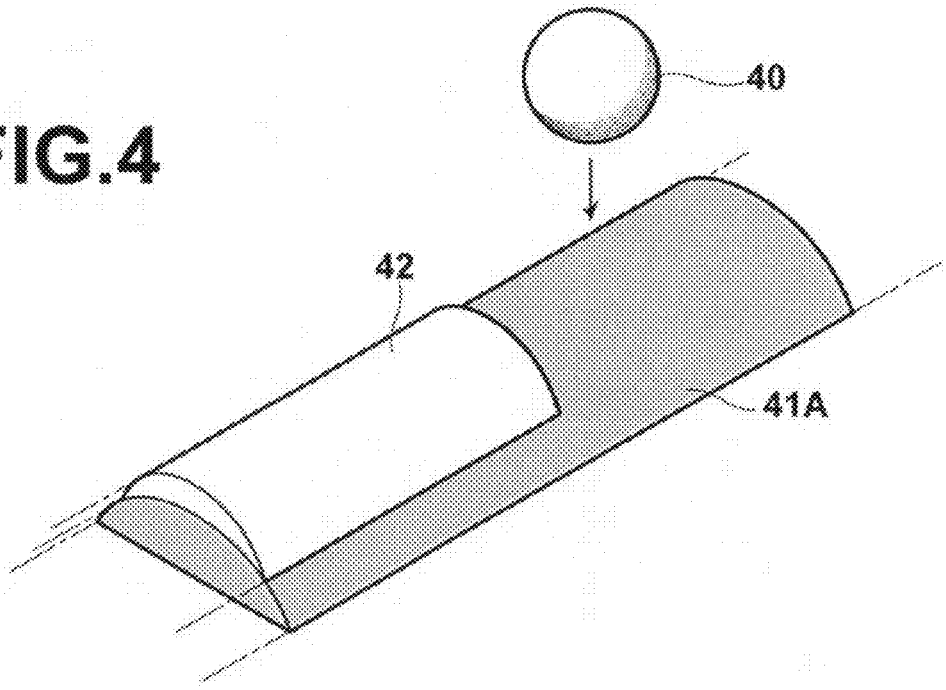
FIG. 4 is a diagram for explaining formation of a pattern in a second layer.

FIG. 4 is a diagram for explaining formation of a pattern in the second layer. As illustrated in FIG. 4, a droplet 40 of ink ejected from the inkjet head 18 lands onto cured pattern 41A in the first layer, and a pattern 42 for the second layer is formed. In FIG. 4, the dot dashed lines indicate the form of the patterns. As illustrated in FIG. 4, the formed pattern has semi-cylindrical form, or the cross section of the formed pattern is crescent-shaped. In FIG. 4, the inkjet head 18 and the substrate 1 are omitted.

Figure 5:
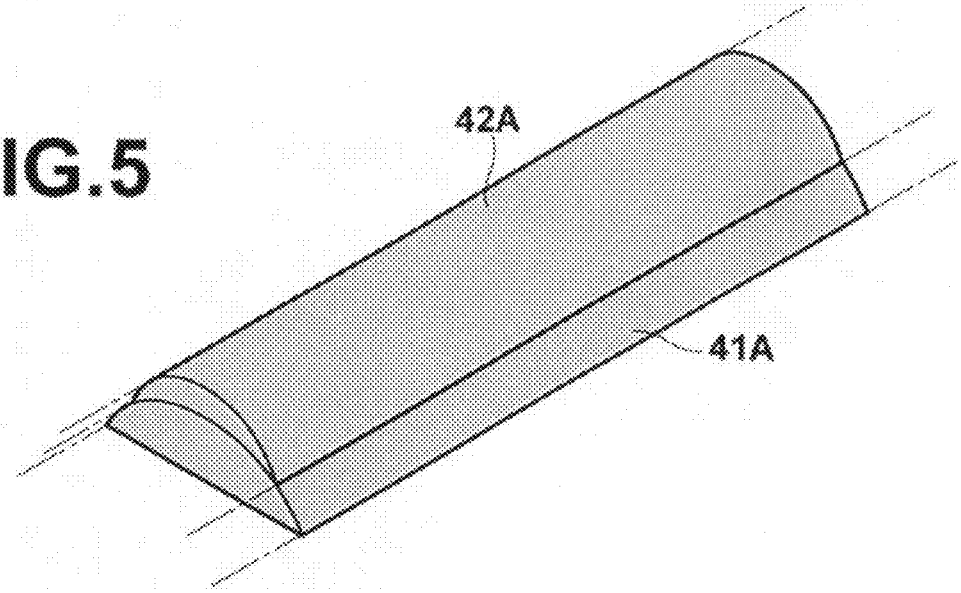
FIG. 5 is a diagram illustrating a state in which the pattern in the second layer has been cured.

In a manner similar to formation of the first layer, the operation of dropping ink from the inkjet head 18 and the operation of moving the substrate 1 by the support member movement means 16 by a predetermined distance are repeated to drop the ink onto the entire surface of the cured ink on the substrate 1 so as to form a predetermined pattern. After then, the ink dropped onto the cured ink is cured (step ST3). Specifically, in a manner similar to step ST2, while the support member movement mechanism 16 conveys the substrate 1 at a predetermined speed, the exposure mechanism 22 outputs light to the substrate 1 to cure the dropped ink. The conveyance speed of the substrate 1 by the support member movement mechanism 16 and the intensity of light output from the exposure mechanism 22 are the conditions set in step ST1. FIG. 5 is a diagram illustrating a state in which the pattern in the second layer has been cured. As illustrated in FIG. 5, cured pattern 42A in the second layer is deposited onto pattern 41A in the first layer.

When the ink dropped onto the substrate 1 is cured, judgment is made as to whether a pattern has been completed (step ST4). If it is judged that the pattern has not been formed, in other words, if it is judged that it is necessary to form a layer by dropping more ink, the processing goes back to step ST1, and the process of dropping ink and the process of curing the ink are repeated for the next layer. When it is judged that the pattern has been completed, the processing ends.

As described above, the pattern formation apparatus 10 repeats the process of dropping ink and the process of curing the ink to form a predetermined pattern. Accordingly, the pattern formation apparatus 10 forms the pattern by depositing layers of cured ink one on another.

As described above, according to the present embodiment, when the dot pitch of the ink to be dropped is p, and the minimum dot pitch for preventing the dropped ink from spreading beyond cured landing-position ink, which is located at the landing position of the dropped ink, is $p_{min}$, the ink is dropped at dot pitch p that satisfies $p_{min} \leqq p$. Therefore, according to the present embodiment, it is possible to drop the ink without making the dropped ink spread beyond the area of the cured ink (in other words, without making the dropped ink spread beyond the boundary of the cured ink). Consequently, it is possible to form a high-resolution pattern with a high aspect ratio without losing the flexibility and productivity of the apparatus and method. Hence, it is possible to form a thick linear pattern at high productivity.

Further, when the maximum dot pitch $p_{max}$ that can avoid jaggy generation is $p_{max}$, it is possible to form a pattern without jaggy by dropping the ink so that $p \leqq p_{max}$ is satisfied.

Next, an example of a method for calculating the dot pitch p will be described in detail. The contact angle $\theta_n$ between the dropped ink and the cured ink located at the ink landing position, at which the dropped ink lands, is necessary to calculate the dot pitch p. Therefore, first, a method for calculating the contact angle $\theta_n$ will be described.

The control unit 24 stores corresponding relationships among contact angle $\theta_n$ that has been calculated in advance by an experiment or the like, the properties (composition, viscosity, or the like) of the ink to be dropped, the properties of ink that has been cured on the substrate 1, and the degree of cure of the ink. The control unit 24 calculates the properties of the ink based on the kind of the cured ink and the kind of the ink to be dropped. Further, the control unit 24 calculates the degree of cure of the cured ink based on the exposure condition (specifically, the speed of conveyance, the intensity of light or the like during exposure) by the exposure mechanism 22. The control unit 24 calculates, based on the result of calculation and the stored corresponding relationships, the contact angle $\theta_n$ between the dropped ink and the cured ink at the landing position of the dropped ink.

Next, the method for calculating the corresponding relationships between the degree of cure of the ink and the contact angle $\theta_n$, which are stored in advance in the control unit 24, will be described in detail by using specific examples.

In this example, ultraviolet-ray curable monomer ink is used, and a quartz substrate is used as the substrate 1, and a UV (ultraviolet) lamp (Spot-Cure SP-7, produced by USHIO INC.) is used as the exposure mechanism. The ultraviolet-ray curable monomer ink is prepared by mixing a monomer, a photo-polymerization initiator, a polymerization inhibitor, a polymerization inhibitor, a surface-active agent, and a pigment. First, the ink is applied to the entire surface of the substrate 1 by bar coating, and the applied ink is exposed to light for a predetermined time period by the exposure mechanism to produce a cured-ink-coated sample. Further, the ink is dropped onto the cured-ink-coated sample.

Next, contact angle meter DM 700 (produced by Kyowa Interface Science, Co., Ltd.) is used, and the contact angle between the dropped ink and cured-ink-coated sample is measured by contact-type liquid-drop method. Further, this measurement of the contact angle is carried out for various exposure time periods by changing only the time period of exposure by the exposure mechanism.

Figure 6:
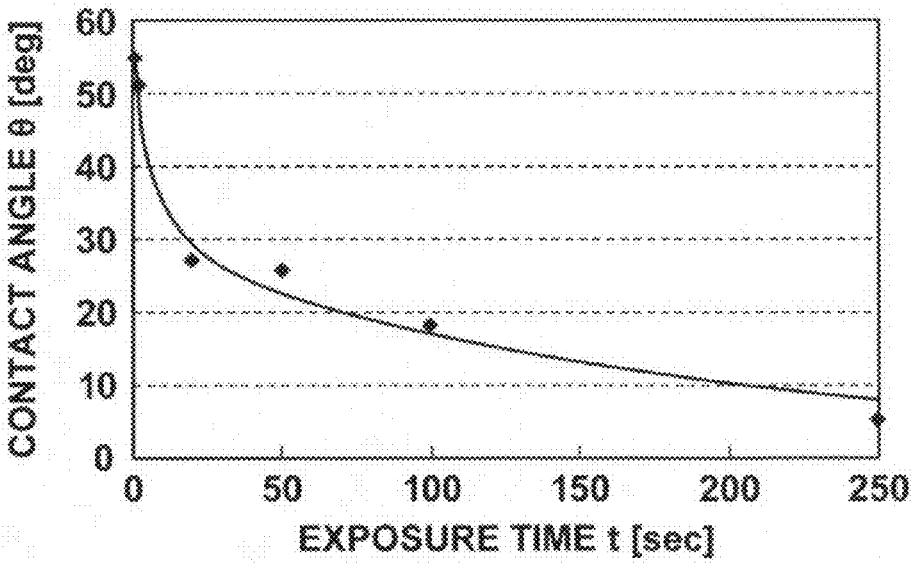
FIG. 6 is a graph showing relationships between exposure time periods and contact angles.

FIG. 6 is a diagram illustrating the result of measurement. In FIG. 6, the horizontal axis indicates exposure time period t [sec], and the vertical axis indicates contact angle θ [deg]. FIG. 6 shows that the contact angle between the dropped ink and the cured-ink-coated sample changes by changing the exposure time period. In other words, the contact angle between the dropped ink and the cured ink changes when the exposure time period changes. Specifically, FIG. 6 shows that the contact angle changes float 5 degrees to 55 degrees depending on the exposure time period.

When the relationships between the contact angle and the exposure time period, as illustrated in FIG. 6, are measured for each exposure condition or for each ink used for pattern formation, and stored in the control unit 24, the contact angle can be calculated based on various conditions.

Next, the method for calculating minimum dot pitch $P_{min}$ and maximum dot pitch $p_{max}$, which regulate dot pitch p, will be described. First, the method for calculating minimum dot pitch $P_{min}$ will be described.

Figure 7:
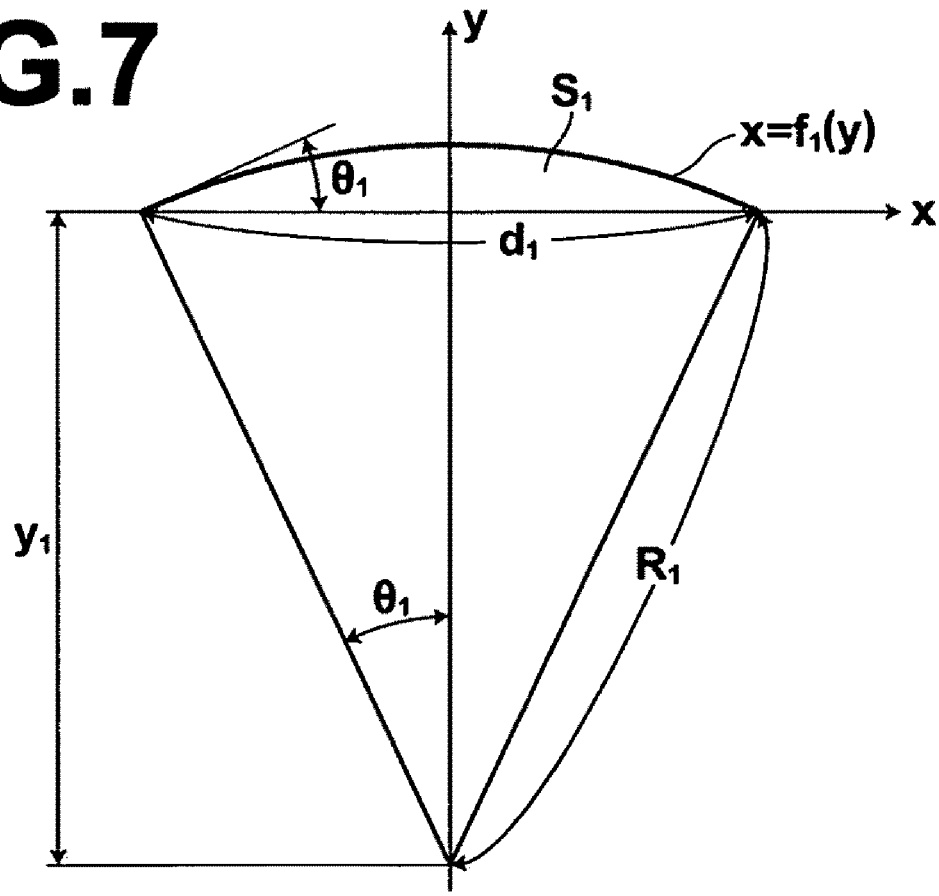
FIG. 7 is a schematic diagram illustrating a cross section of a linear pattern formed by dropping ink onto a substrate.
Figure 8:
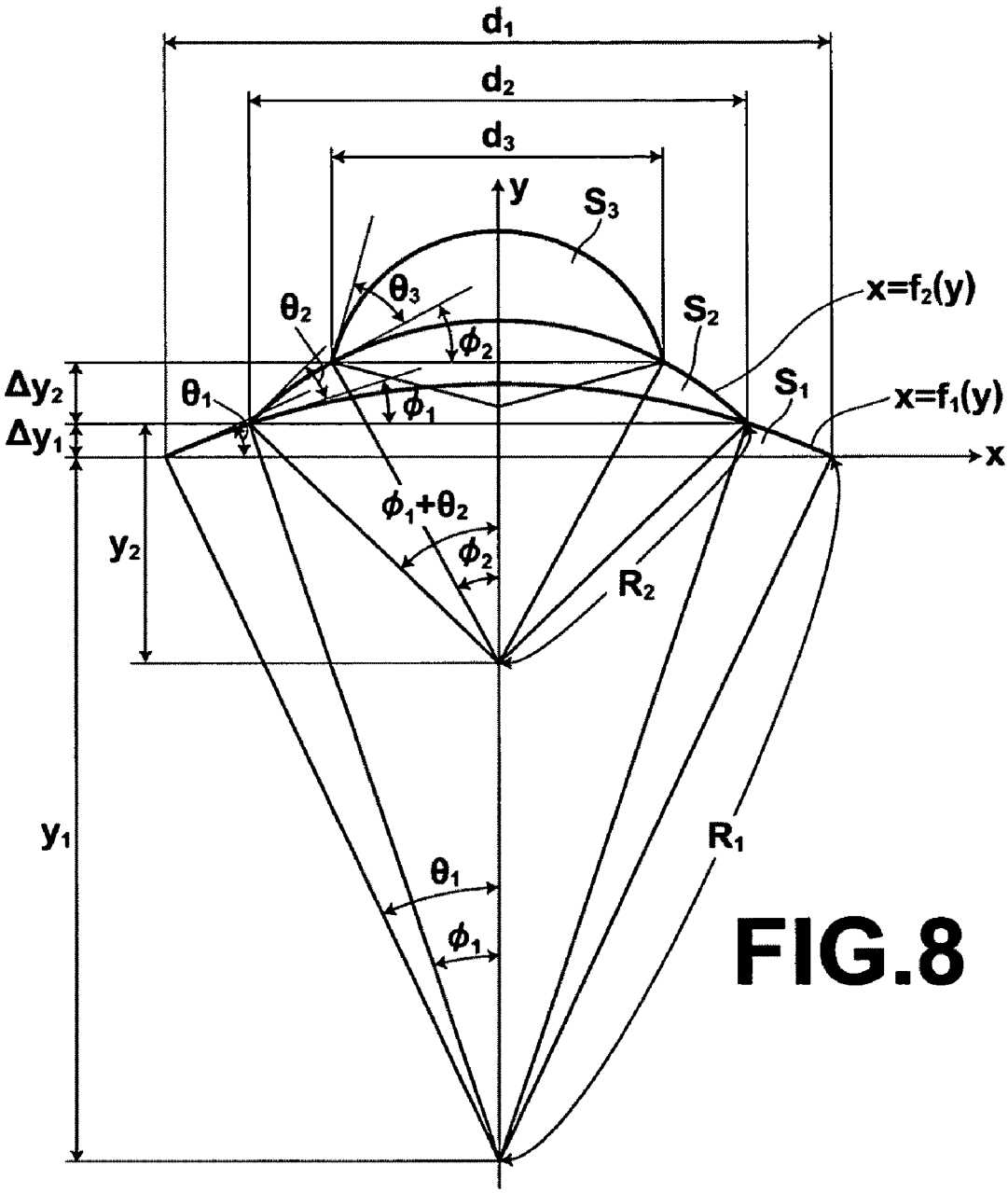
FIG. 8 is a schematic diagram illustrating a cross section of a linear pattern formed by dropping ink onto cured ink.

FIG. 7 is a schematic diagram illustrating a cross section of a linear pattern formed by dropping ink onto the substrate. FIG. 8 is a schematic diagram illustrating a cross section of a linear pattern formed by dropping ink onto the cured ink.

First, with respect to the ink that lands onto the substrate 1 (specifically, the ink that directly lands onto the substrate 1, and hereinafter, also referred to as "first ink"), the form of the cross section of the first ink is modeled by using curvature radius $R_1$, as illustrated in FIG. 7. In FIG. 7, axis x (an axis parallel to the substrate 1) and axis y (axis perpendicular to the substrate 1 and passing through the center of the ink) with respect to the origin that is the center of the contact surface between the ink and the substrate 1 are axes in this model. Therefore, the directions of axis x and axis y differ from direction X and direction Y illustrated in FIG. 1.

The modeled first ink has line width $d_1$, contact angle $\theta_1$ between the substrate 1 and the first ink, and the area $S_1$ of a cross section. Further, a distance from the center of the arc forming the surface of the ink to the substrate 1 is $y_1$. Here, the profile of the cross section of the first ink can be represented by the following formula (1):

$$x=\pm\sqrt{R_1^2-(y_1+y_1)^2},\ \text{and}\ y_1\geqq 0 \tag{1}$$

Values $y_1$ and $R_1$ in Formula (1) are as represented by the following formula (2):

$$y_1=\frac{d_1}{2\tan\theta_1},\quad R_1=\frac{d_1}{2\sin\theta_1}. \tag{2}$$

Accordingly, the area $S_1$ of a cross section is represented by the following formula (3):

$$\begin{aligned} S_1 &= \int_{-\frac{1}{2}d_1}^{\frac{1}{2}d_1} f(x)\,dx \\ &= 2\left(\pi R_1^2\theta_1-\frac{1}{4}d_1y_1\right) \\ &= 2\left(\pi\frac{d_1^2}{4\sin^2\theta_1}\theta_1-\frac{1}{4}d_1\frac{d_1}{2\tan\theta_1}\right) \\ &= d_1^2\left(\pi\frac{\theta_1}{2\sin^2\theta_1}-\frac{1}{4\tan\theta_1}\right). \end{aligned} \tag{3}$$

As the formula (3) shows, the area $S_1$ of the cross section is a function of line width $d_1$ and contact angle $\theta_1$.

Next, as illustrated in FIG. 8, the state in which ink is dropped onto the cured ink is modeled. In FIG. 8, three layers of ink are deposited onto the substrate 1. In the following explanation, a case in which the n-th layer of ink is deposited onto (n−1) layers of ink, which are deposited one on another, will be described. Specifically, a case in which after the (n−1) th layer of ink (hereinafter, referred to as "(n−1)th ink") is cured, the n-th layer of ink (hereinafter, referred to as "n-th ink") is dropped on the (n−1)th ink will be described.

First, when the n-th ink landed onto the cured (n−1)th ink is modeled by using arc form, the profile of the cross section of the n-th ink can be represented by the following formula (4):

$$f_n(x)=\pm\sqrt{R_n^2-x^2}-y_n+\sum_{k=1}^{n-1}\Delta y_k. \tag{4}$$

Values $y_n$, $\Delta y$, and $R_n$ in the formula (4) can be represented by the following formulas (5) through (7), respectively. Further, value $\Phi_{n-1}$ is an angle between the tangent line to the surface of the (n−1)th ink and a plane parallel to the surface of the substrate 1 at the contact point between the surface of the n-th ink and the (n−1)th ink, as represented by the following formula (8):

$$y_n=\frac{d_n}{2\tan(\phi_{n-1}+\theta_n)} \tag{5}$$

$$\Delta y_k=R_k\cos\phi_k-y_k \tag{6}$$

$$R_n=\frac{d_n}{2\sin(\phi_{n-1}+\theta_n)} \tag{7}$$

$$\phi_{n-1}=\sin^{-1}\frac{d_n}{2R_{n-1}}. \tag{8}$$

When the relationships represented by the formulas (4) through (8) are used, the area $S_n$ of a cross section is represented by the following formula (9):

$$\begin{aligned} S_n &= 2\int_0^{\frac{d_n}{2}}(f_n-f_{n-1})\,dx \\ &= \left[(\phi_{n-1}+\theta_n)\frac{d_n}{2\sin(\phi_{n-1}+\theta_n)}-\right. \\ &\quad \left\{(\phi_{n-2}+\theta_{n-1})\frac{d_{n-1}}{2\sin(\phi_{n-2}+\theta_{n-1})}-\right. \\ &\quad \left.\left.\frac{d_n}{4}\left(\frac{d_{n-1}}{\tan(\phi_{n-2}+\theta_{n-1})}-\frac{d_n}{\tan(\phi_{n-1}+\theta_n)}\right)\right\}\right]. \end{aligned} \tag{9}$$

As the formula (9) shows, the area $S_n$ of a cross section can be represented by $d_n$, $d_{n-1}$, $\theta_n$, $\theta_{n-1}$, and $\Phi_{n-1}$. The shape of the pattern formed by the (n−1)th ink can be represented by $d_{n-1}$ and $\Phi_{n-1}$ in the formula (9). Values $\theta_n$ and $\theta_{n-1}$ are contact angles. Therefore, the area $S_n$ of the cross section can be calculated based on the contact angle and the shape of the pattern formed by the (n−1)th ink.

Here, values $d_{n-1}$, $\theta_{n-1}$ and $\Phi_{n-1}$ are values related to the (n−1)th ink. Therefore, when the n-th ink is dropped, these values have already been given as definite values. Further, when the n-th ink is dropped, the properties of the ink that is dropped as the n-th ink, and the properties and the cure conditions of the (n−1)th ink have been given as definite values. Therefore, value $\theta_n$ is also given as a definite value. Therefore, when the n-th ink is dropped, only values $d_n$ and $S_n$ are variables in the formula (9).

Here, the area S ($d_n=d_{n-1}$) of a cross section representing the maximum drop amount of the n-th ink that satisfies $d_n=d_{n-1}$ can be calculated by using the formula (9). When the amount of ink to be dropped is V, the relation $p\cdot S_n=V$ is satisfied within the range of dot pitch $p\leqq p_{max}$. Therefore, the minimum dot pitch $p_{min}$ for preventing the dropped ink from spreading beyond the layer under the layer of the dropped ink can be calculated by the following formula (10):

$$p_{min} = \frac{V}{S_n(d_n = d_{n-1})}. \quad (10)$$

Next, a method for calculating the maximum dot pitch $p_{max}$ will be described. "The Impact and Spreading of Ink Jet Printed Droplets, Jonathan Stringer and Brian Derby, Digital Fabrication, 2006, 128-130" describes that when the volume of ink per droplet is less than or equal to the volume of the line in one dot pitch, jaggy is generated. Here, when the diameter of a dot of the n-th ink that is dropped and spreads on the (n−1)th ink is $d_{dot}$, the area S ($d_n$=$d_{dot}$) of the cross section, which represents the minimum drop amount of the n-th ink that satisfies $d_n$=$d_{dot}$, can be calculated. Therefore, when a droplet of drop amount is V, the relation $p \cdot S_n$=V is satisfied in the range of dot pitch $p \leqq p_{max}$. Therefore, the maximum dot pitch p is calculated by the following formula (11):

$$p_{max} = \frac{V}{S_n(d_n = d_{dot})}. \quad (11)$$

Therefore, the control unit 24 calculates dot pitch p so that $p_{min} \leqq p \leqq p_{max}$ is satisfied. Specifically, the dot pitch p is calculated so as to satisfy $$\frac{V}{S_n(d_n = d_{n-1})} \leq p \leq \frac{V}{S_n(d_n = d_{dot})}.$$

As described above, when the ink is dropped at the calculated dot pitch p, it is possible to drop the ink on the cured ink without making the dropped ink spread beyond the cured ink. Further, it is possible to form a pattern without jaggy.

Further, the area $S_n$ of the cross section is calculated by using the formula (9) for the case of $d_n$=$d_{n-1}$, and the minimum dot pitch $p_{min}$ is calculated by using the formula (10). In this manner, it is possible to maximize the drop amount without making the dropped ink spread beyond the cured ink. Specifically, the maximum amount of ink can be dropped in such a manner that the dropped ink does not spread beyond the cured ink.

In the above embodiment, the drop amount of the ink in every layer is the same. Alternatively, the drop amount of the ink may be changed in each layer. In this case, the minimum dot pitch $p_{min}$ and the maximum dot pitch $p_{max}$ should be calculated for each layer based on the amount V of the ink to be dropped for each layer.

In the above embodiment, it is possible to prevent the dropped ink from spreading beyond the ink onto which the ink has landed by setting the dot pit p to satisfy $p_{min} \leqq p$. Optionally, error a (for example, 2 μm) in the ink landing position caused by the inkjet head may be considered and the dot pitch may be set so as to satisfy $p_{min} \leqq p+a$. When the dot pitch p is calculated so as to satisfy $p_{min} \leqq p+a$, it is possible to accurately prevent the dropped ink from spreading beyond the cured ink.

Further, as described above, the contact angle θ can be adjusted by changing the exposure condition. Therefore, when the dropped ink is cured, it is desirable that the control unit 24 adjusts the exposure conditions, such as the conveyance speed of the support member 14 and the intensity of light output from the exposure mechanism 22. When the exposure conditions are adjusted as described above, and the contact angle θ between the cured ink and the ink to be dropped in the next is adjusted, it is possible to further increase the amount of ink to be dropped.

Further, immediately before formation of the pattern, the minimum dot pitch $p_{min}$ may be calculated based on the relationship between the contact angle θ and the area $S_n$ of the cross section that satisfies $d_n$=$d_{n-1}$. Further, the drop conditions may be set based the result of calculation to form the pattern. Accordingly, it is possible to monitor the intensity of exposure light to form a pattern at dot pitch p that is even more desirable.

Figure 9:
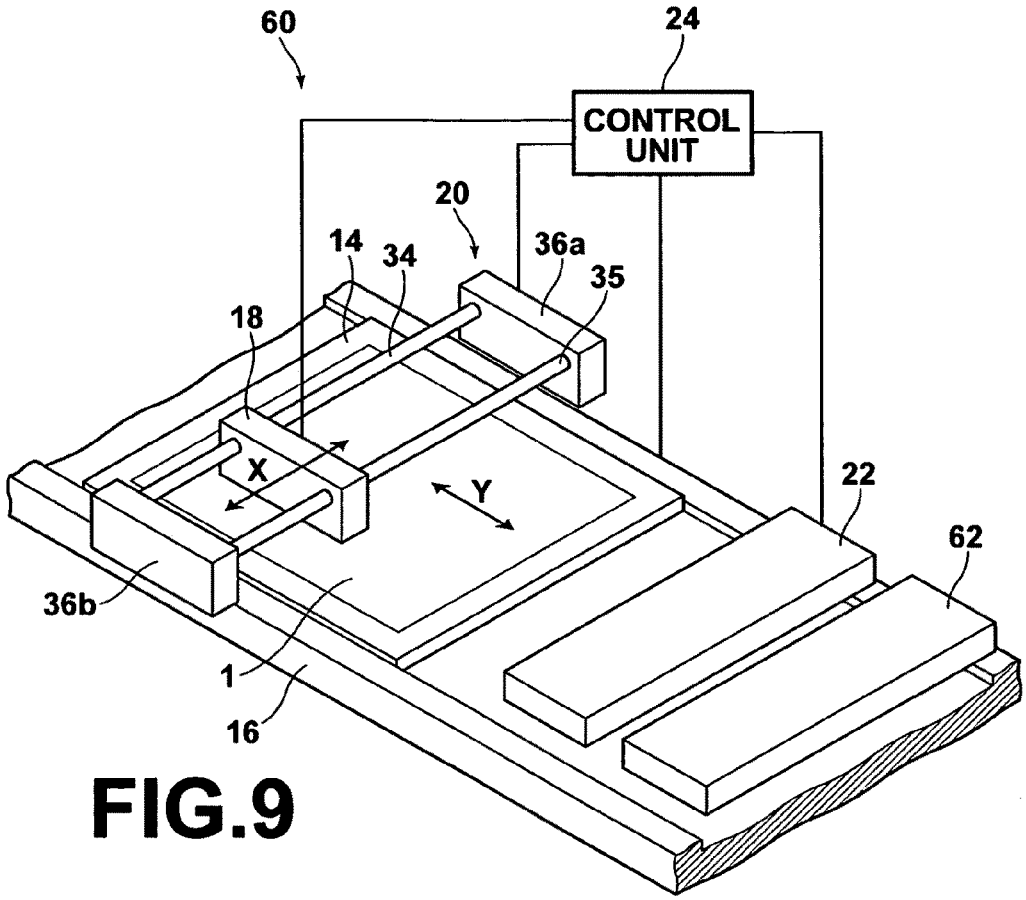
FIG. 9 is a schematic diagram illustrating a perspective view of the structure of a pattern formation apparatus for carrying out a pattern formation method according to another embodiment of the present invention.

Next, another embodiment of the present invention will be described. FIG. 9 is a schematic diagram illustrating a perspective view of a pattern formation apparatus for carrying out a pattern formation method according to another embodiment of the present invention. In a pattern formation apparatus 60 illustrated in FIG. 9, the same reference numerals are assigned to elements that are the same as the elements in the pattern formation apparatus 10 illustrated in FIG. 1, and the detailed descriptions thereof will be omitted. As FIG. 9 illustrates, the pattern formation apparatus 60 according to this embodiment differs from the pattern formation apparatus 10 illustrated in FIG. 1 in that the pattern formation apparatus 60 includes a liquid-repellent treatment mechanism 62.

The liquid-repellent treatment mechanism 62 carries out liquid-repellent treatment on the surface of the cured ink. The liquid-repellent treatment mechanism 62 is arranged in such a manner to face a substrate-1-supporting surface of the support member 14 and to cover the support member 14 from an end to the opposite end of the support member 14 in direction X. Further, the liquid-repellent treatment mechanism 62 is arranged on a side of the exposure mechanism 22, the side opposite to the inkjet-head-18-facing side of the exposure mechanism 22, in such a manner to be spaced from the exposure mechanism 22 by a predetermined distance.

As the liquid-repellent treatment carried out by the liquid-repellent treatment mechanism 62, various methods may be used. For example, the liquid-repellent treatment may be carried out by applying fluorine-based resin, such as FIFE (polytetrafluoroethylene), to the entire surface of the substrate 1, across which the liquid-repellent treatment mechanism 62 passes. The fluorine-based resin may be applied by spin coating, vapor deposition, or the like, and dried. In this manner, a liquid-repellent surface is formed on both of the surface of the substrate 1 and the surface of the ink. Alternatively, a processing method of fluorine resin disclosed in Japanese Unexamined Patent Publication No. 2000-017091 and a method for carrying out liquid-repellent treatment by ultra-water-repellent treatment disclosed in "Effect of Ar Ion Implantation on Ultra-Water-Repellent Characteristic of Fluorine Resin (Proceedings of the 15th Symposium on Surface Layer Modification by Ion Implantation)" or the like may be used.

The liquid-repellent treatment mechanism 62 carries out liquid-repellent treatment on the surface of the ink on the substrate 1 that has been conveyed to a position facing the liquid-repellent treatment mechanism 62 by the support member movement mechanism 16.

As described above, the contact angle between the cured ink and the dropped ink can be adjusted also by carrying out liquid-repellent treatment on the surface of the cured ink. When the contact angle is adjusted, the range of the dot pitch p can be adjusted.

The liquid-repellent mechanism 62 may determine, based on the cured ink, whether liquid-repellent treatment is carried out and the degree of liquid-repellent treatment. When the liquid-repellent treatment is selectively carried out, it is possible to adjust the droppable drop amount and the range of the dot pitch p.

Further, it is desirable that the drive waveform of the inkjet head 18 is adjusted and that the drop amount of ink dropped from the inkjet head 18 at one time is adjusted. Accordingly, it is possible to adjust the drop amount of ink to a desirable amount. The drive waveform of the inkjet head 18 may be adjusted by using general inkjet techniques, for example, by adjusting the applied voltage, the pulse width, the timing of ebb and flow of the pulse, or the like. Especially, when a piezoelectric inkjet head is used, the drop amount can be adjusted appropriately by adjusting the drive waveform.

Optionally, the inkjet head 18 may be adjusted in such a manner that the ink drop amount becomes a desirable amount by adjusting (selecting) the number of droplets of ink to be dropped. For example, after ink is dropped, if ink further lands onto the same position as the dropped ink without curing the dropped ink, it is possible to increase the drop amount of the ink to the same position. When the drop amount of ink is adjusted by adjusting the number of droplets of ink, it is possible to average shifts in the landing positions of the ink.

When the drop amount is adjusted as described above, the minimum dot pitch $p_{min}$ and the maximum dot pitch $p_{max}$ should be calculated based on the adjusted drop amount by using the formulas (10) and (11).

Further, in the pattern formation apparatus 10, one kind of ink is dropped from the inkjet head 18. However, it is not necessary that the kind of ink is one. A plurality of kinds of ink that have different properties may be dropped from the inkjet head 18 if necessary. As described above, the kind of the ink to be dropped may be changeable. The contact angle can be adjusted by changing the kind of the ink to be dropped if the kind of the ink to be dropped is changeable.

In this case, a plurality of inkjet heads 18 may be provided, and a different kind of ink may be dropped front each of the inkjet heads 18. Alternatively, one ink selected from a plurality of kinds of ink may be dropped from a single inkjet head 18.

In the above descriptions, the pattern formation apparatus 10 includes the single ink drop mechanism (the inkjet head 18 and the head movement mechanism 20) and the single exposure mechanism 22. However, the present invention is not limited to such configuration.

Figure 10:
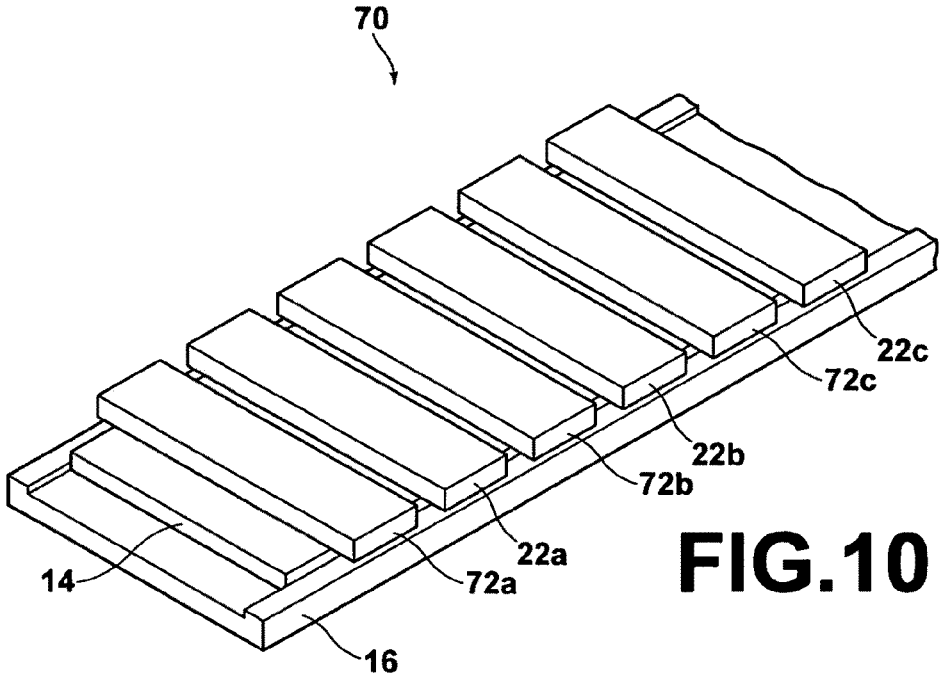
FIG. 10 is a schematic diagram illustrating a perspective view of the structure of a pattern formation apparatus for carrying out a pattern formation method according to still another embodiment of the present invention.

FIG. 10 is a schematic diagram illustrating a perspective view of a pattern formation apparatus for carrying out a pattern formation method according to still another embodiment of the present invention. A pattern formation apparatus 70 illustrated in FIG. 10 differs from the pattern formation apparatus 10 illustrated in FIG. 1 in that the pattern formation apparatus 70 includes a plurality of ink drop mechanisms 72*a*, 72*b*, and 72*c* and a plurality of exposure mechanisms 22*a*, 22*b*, and 22*c*.

Each of the ink drop mechanisms 72*a*, 72*b*, and 72*c* includes the inkjet head 18 and the head movement mechanism 20 of the pattern formation apparatus 10. The structure of each of the elements is similar to that of the inkjet head 18 and the head movement mechanism 20.

The pattern formation apparatus 70 includes the ink drop mechanism 72*a*, the exposure mechanism 22*a*, the ink drop mechanism 72*b*, the exposure mechanism 22*b*, the ink drop mechanism 72*c* and the exposure mechanism 22*c* that are arranged on the surface of the support member movement mechanism 16, the surface on which the support member 14 is placed. These mechanisms are arranged in the mentioned order fruit an end toward the other end of the support member movement mechanism 16 along the conveyance direction. Specifically, the ink drop mechanisms and the exposure mechanisms are alternately arranged.

In the pattern formation apparatus 70, the support member 14 on which the substrate 1 is placed is conveyed, in one direction, by the support member movement mechanism 16. The support member 14 passes the ink drop mechanism 72*a*, the exposure mechanism 22*a*, the ink drop mechanism 72*b*, the exposure mechanism 22*b*, the ink drop mechanism 72*c*, and the exposure mechanism 22*c* in this order. Accordingly, after the ink is dropped fruit the ink drop mechanism 72*a*, the dropped ink is cured by the exposure mechanism 22*a*. After then, the ink is further dropped onto the cured ink on the substrate 1 by the ink drop mechanism 72*b*. The exposure mechanism 22*b* cures the dropped ink. Further, the ink drop mechanism 72*c* drops the ink onto the ink cured on the substrate 1, and the exposure mechanism 22*c* cures the dropped ink.

When a plurality, of ink drop mechanisms and a plurality of exposure mechanisms are provided, and they are alternately arranged, as described above, it is possible to form a pattern including a plurality of layers of ink deposited one on another by conveying the substrate 1 only in one direction.

In the pattern formation apparatus 70 illustrated in FIG. 10, the number of the ink drop mechanisms and the number of the exposure mechanisms are not particularly limited. The number of the ink drop mechanisms and the number of the exposure mechanisms may be two, or even greater than or equal to 4. Further, when a plurality of ink drop mechanisms and a plurality of exposure mechanisms are provided and the substrate 1 is moved forward and backward, the ink may be deposited not only in the forward operation but also in the backward operation by using a pair of an ink drop mechanism and an exposure mechanism next to each other to repeat dropping ink and curing the ink. Alternatively, the number of the ink drop mechanisms may be greater than the number of the exposure mechanisms by one, and both of the start end and the last end of the conveyance path may be constituted by the ink drop mechanisms. If the ink drop mechanisms are provided in such a manner, when the substrate passes under the exposure mechanisms in both of the forward path and the backward path, the dropped ink before cure is always present on the substrate. Hence, it is possible to efficiently form a pattern.

Further, the pattern formation apparatuses as described above may be used as an apparatus for producing a micro TAS (total analysis system) for analyzing various kinds of liquid and gas by providing a micro structure, such as chip-form micro flow path, for example. Specifically, the pattern formation apparatus of the present embodiment may be used to form division walls constituting the flow path in the micro TAS.

So far, the pattern formation method of the present invention has been described in detail. The present invention is not limited to the above embodiments of the present invention, and various improvements and modifications are possible without departing from the gist of the present invention.

For example, in the pattern formation apparatus 10 in the above embodiment, the inkjet head 18 is a shuttle type head that is moved (scan-moved) by the head movement mechanism. However, it is not necessary that the inkjet head 18 is the shuttle type. For example, the inkjet head 18 may be a line-type inkjet head that can drop ink onto the entire area of the substrate 1 in a direction perpendicular to the conveyance direction of the substrate 1. In such a case, the ink may be dropped onto the entire surface of the substrate 1 by conveying the substrate 1 only in one direction without moving the inkjet head 18. Alternatively, the substrate 1 may be fixed, and the inkjet head 18 may be moved two-dimensionally (X-Y directions) to drop the ink onto the entire surface of the substrate 1. In this case, it is necessary that a movement mechanism for the exposure mechanism 22 is provided to move the exposure mechanism 22.

Further, the color of the ink is not particularly limited. The color may be any color or transparent.

In the above embodiments, the photo-curable ink is used. However, it is not necessary that the photo-curable ink is used in the present invention. A thermally curable ink or a wax ink may be used.

When the photo-curable ink is not used, a cure mechanism that outputs energy for curing the adopted ink should be used instead of the exposure mechanism 22.

Further, it is not necessary that the substrate 1 is a smooth plate member. The substrate 1 may have an uneven surface.

What is claimed is:

1. A pattern formation method comprising the steps of:

dropping curable ink linearly onto a substrate;

curing the ink dropped onto the substrate; and depositing layers of ink to form a linear pattern by repeating a process of linearly dropping a predetermined amount of ink onto the cured ink and a process of curing the predetermined amount of ink, wherein in the step of depositing layers of ink, the ink is dropped at dot pitch p that satisfies $p_{min} \leqq p$ when the ink is dropped at dot pitch p, and a minimum dot pitch for preventing the dropped ink from spreading beyond cured landing-position ink that is located at a landing position of the dropped ink is $p_{min}$, wherein the minimum dot pitch $p_{min}$ is determined based on the predetermined amount of ink and the area of a cross section of a pattern formed by the dropped ink, and when a contact angle between the dropped ink and the landing-position ink is $\theta_n$, a contact angle between the landing-position ink and an object on which the landing-position ink has landed is $\theta_{n-1}$, an angle between a tangent line to the surface of the landing-position ink and a plane parallel to the surface of the substrate at a point of contact between the surface of the dropped ink and the landing-position ink is $\phi_{n-1}$, an angle between a tangent line to the surface of an object and a plane parallel to the surface of the substrate at a point of contact between the landing-position ink and the object on which the landing-position ink has landed is $\phi_{n-2}$, and the area of the cross section is $S_n$, the area $S_n$ of the cross section is calculated by the following formula:

$$S_n = \left[(\phi_{n-1} + \theta_n)\frac{d_n}{2\sin(\phi_{n-1} + \theta_n)} - \left\{(\phi_{n-2} + \theta_{n-1})\frac{d_{n-1}}{2\sin(\phi_{n-2} + \theta_{n-1})} - \frac{d_n}{4}\left(\frac{d_{n-1}}{\tan(\phi_{n-2} + \theta_{n-1})} - \frac{d_n}{\tan(\phi_{n-1} + \theta_n)}\right)\right\}\right].$$

2. A pattern formation method, as defined in claim 1, wherein in the step of depositing layers of ink, the ink is dropped at dot pitch p that further satisfies $p \leqq p_{max}$ when a maximum dot pitch that can avoid jaggy generation is $p_{max}$.

3. A pattern formation method, as defined in claim 1, wherein in the step of depositing layers of ink, the ink is dropped at dot pitch p that satisfies $p_{min} \leqq p+a$ when the accuracy of landing by the dropped ink is a.

4. A pattern formation method, as defined in claim 1, wherein in the step of depositing layers of ink, the area of the cross section is calculated based on a contact angle between the dropped ink and the landing-position ink.

5. A pattern formation method, as defined in claim 4, wherein the ink is curable by irradiation with an electromagnetic wave including a visible ray or an invisible ray, and wherein in the step of curing the ink, the ink is cured by irradiating the ink with the electromagnetic wave, and wherein in the step of depositing layers of ink, the contact angle is controlled based on the properties of the ink and the time period and the intensity of irradiating the landing-position ink.

6. A pattern formation method, as defined in claim 4, the method further comprising the step of:

carrying out liquid-repellent treatment on a surface of the ink that has been cured in the step of curing, wherein in the step of depositing layers of ink, after the dropped ink is cured, liquid-repellent treatment is carried out on the surface of the cured dropped ink, and wherein the contact angle is controlled based on the properties of the ink on which the liquid-repellent treatment has been carried out.

7. A pattern formation method, as defined in claim 1, wherein in the step of depositing layers of ink, the ink is dropped from a piezoelectric-type inkjet head, and the predetermined amount of ink is adjusted by the waveform of drive voltage applied to a piezoelectric element of the piezoelectric-type inkjet head.

8. A pattern formation method, as defined in claim 1, wherein in the step of depositing layers of ink, the predetermined amount of ink is adjusted by changing the number of times dropping the ink.

* * * * *